US006325035B1

(12) United States Patent
Codina et al.

(10) Patent No.: US 6,325,035 B1
(45) Date of Patent: Dec. 4, 2001

(54) METHOD AND APPARATUS FOR STARTING AN ENGINE USING CAPACITOR SUPPLIED VOLTAGE

(75) Inventors: George Codina, Playa del Rey, CA (US); Thomas J. Richards, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/409,572

(22) Filed: Sep. 30, 1999

(51) Int. Cl.[7] ..... F02N 11/08
(52) U.S. Cl. ..... 123/179.1; 290/38 R
(58) Field of Search ..... 123/179.1, 179.3, 123/179.25; 290/38 R

(56) References Cited

U.S. PATENT DOCUMENTS

| | | | | |
|---|---|---|---|---|
| 2,115,671 | * | 4/1938 | Pfister | 290/38 R |
| 5,146,095 | | 9/1992 | Tsuchiya et al. | 290/38 R |
| 5,157,267 | | 10/1992 | Shirata et al. | 290/38 R |
| 5,207,194 | | 5/1993 | Clerici | 123/179.1 |
| 5,260,637 | | 11/1993 | Pizzi | 320/6 |
| 5,563,454 | * | 10/1996 | Araki et al. | 123/179.1 |
| 5,642,696 | | 7/1997 | Matsui | 123/179.1 |
| 5,818,115 | | 10/1998 | Nagao | 290/31 |

OTHER PUBLICATIONS

Derwent abstract for invention disclosure SU 878992, Pogorelyi et al, Nov. 10, 1981.*

* cited by examiner

*Primary Examiner*—Andrew M. Dolinar
(74) *Attorney, Agent, or Firm*—Steve D. Lundquist

(57) ABSTRACT

A method and apparatus for starting an internal combustion engine using energy stored in a capacitor. The method and apparatus includes at least one battery for providing energy at a low voltage, an inverter for receiving the energy at the low voltage and producing energy at a high voltage, a capacitor for receiving and storing the energy at the high voltage, means for removing the low voltage source from the inverter, and at least one starter motor adapted to receive the energy at the high voltage from the capacitor and responsively start the engine.

24 Claims, 5 Drawing Sheets

METHOD AND APPARATUS FOR STARTING AN ENGINE USING CAPACITOR SUPPLIED VOLTAGE

TECHNICAL FIELD

This invention relates generally to a method and apparatus for starting an internal combustion engine and, more particularly, to a method and apparatus for providing a high voltage using the energy stored in a capacitor for starting an engine.

BACKGROUND ART

It has long been a common practice to start internal combustion engines using the energy stored in batteries to drive starter motors, which in turn crank the engine until the engine starts. However, the load placed upon the batteries reduces the life of service of the batteries significantly. A typical battery for starting an engine may only have a useful life of about three years. In addition, the power output of even a good battery may be severely reduced when used under extreme temperature conditions.

Advances have been made in technology regarding capacitors, which are capable of storing electrical energy, but until recently were not capable of storing the amounts of energy needed to start an engine. However, large capacitance capacitors, for example electric double layer capacitors, have been developed which are capable of storing large amounts of electric charge. These capacitors are sometimes known as super capacitors, and are finding use in applications such as in engine starting circuits.

For example, in U.S. Pat. No. 5,157,267, Shirata et al. (Shirata) disclose an apparatus for starting an engine which uses a capacitor in parallel with a starting battery. The battery charges the capacitor through a boost controller, i.e., a DC to DC inverter, to a voltage slightly higher than the battery voltage. For example, for a battery voltage of 12 volts, the capacitor would be charged to 14 volts. The energy stored in the capacitor is then used to start the engine, as the battery continues to charge the capacitor during the start cycle.

Although the apparatus of Shirata uses a capacitor to start an engine, the battery must still continue to work under load to maintain a charge on the capacitor. Therefore, the battery must still be subjected to the stresses of continual quick-draining charge-discharge cycles, thus shortening the useful life of the battery. It would be desirable to provide a starting system for an engine which did not subject the battery to constant discharging and charging during the starting process.

In addition, it may be desired to provide a voltage for starting an engine that is much higher than a battery is capable of providing. For example, a large engine may employ multiple starters in the starting system. These starters are typically connected in parallel to accept a constant voltage, e.g., 36 volts, from a battery source. However, the current requirements for multiple starters in parallel is tremendous, e.g., 3,000 amps. It may be desired to connect the starters in series to maintain a relatively low current drain, e.g., 1,000 amps. Components, as well as the wiring, in the starting system could be used at lower ratings and dimensions. The starters connected in series, however, would require a higher voltage, e.g., about 100 volts. A capacitor charged over a long period of time by a low voltage battery, e.g., one or more batteries providing 36 volts, through an inverter, could store a charge in a capacitor at 100 volts to be used to drive the starters as needed.

The present invention is directed to overcome one or more of the problems set forth above.

DISCLOSURE OF THE INVENTION

In one aspect of the present invention a method for starting an internal combustion engine using energy stored in a capacitor is disclosed. The method includes the steps of providing energy at a low voltage from at least one battery to an inverter, boosting the energy at the low voltage to energy at a high voltage, delivering the energy at the high voltage to a capacitor, removing the low voltage source from the inverter, and delivering the energy at the high voltage from the capacitor to at least one starter motor to responsively start the engine.

In another aspect of the present invention an apparatus for starting an internal combustion engine using energy stored in a capacitor is disclosed. The apparatus includes at least one battery for providing energy at a low voltage, an inverter for receiving the energy at the low voltage and producing energy at a high voltage, a capacitor for receiving and storing the energy at the high voltage, means for removing the low voltage source from the inverter, and at least one starter motor adapted to receive the energy at the high voltage from the capacitor and responsively start the engine.

BEST MODE FOR CARRYING OUT THE INVENTION

Figure 1:
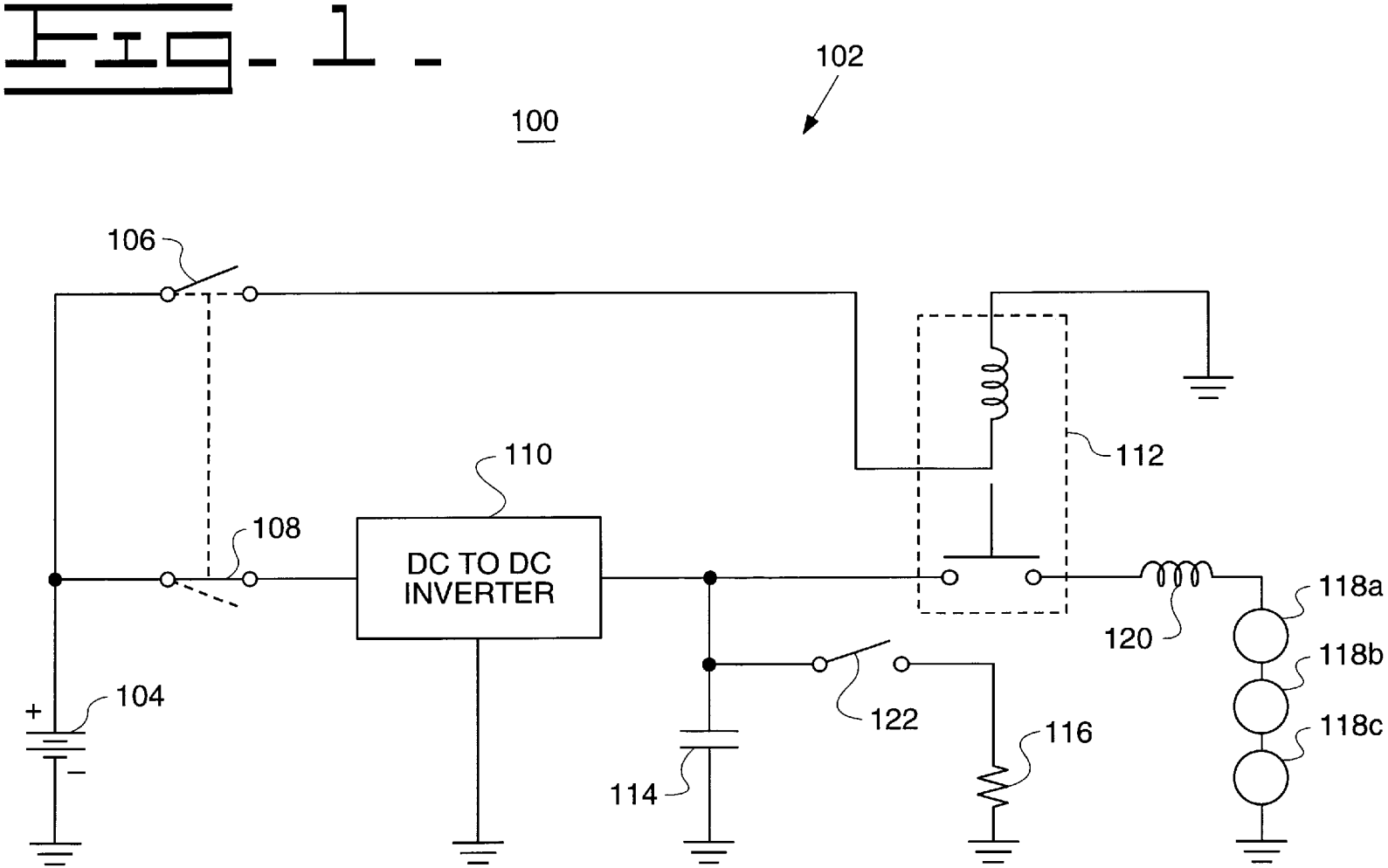
FIG. 1 is an electrical circuit diagram illustrating a preferred embodiment of the present invention.
Figure 1B:
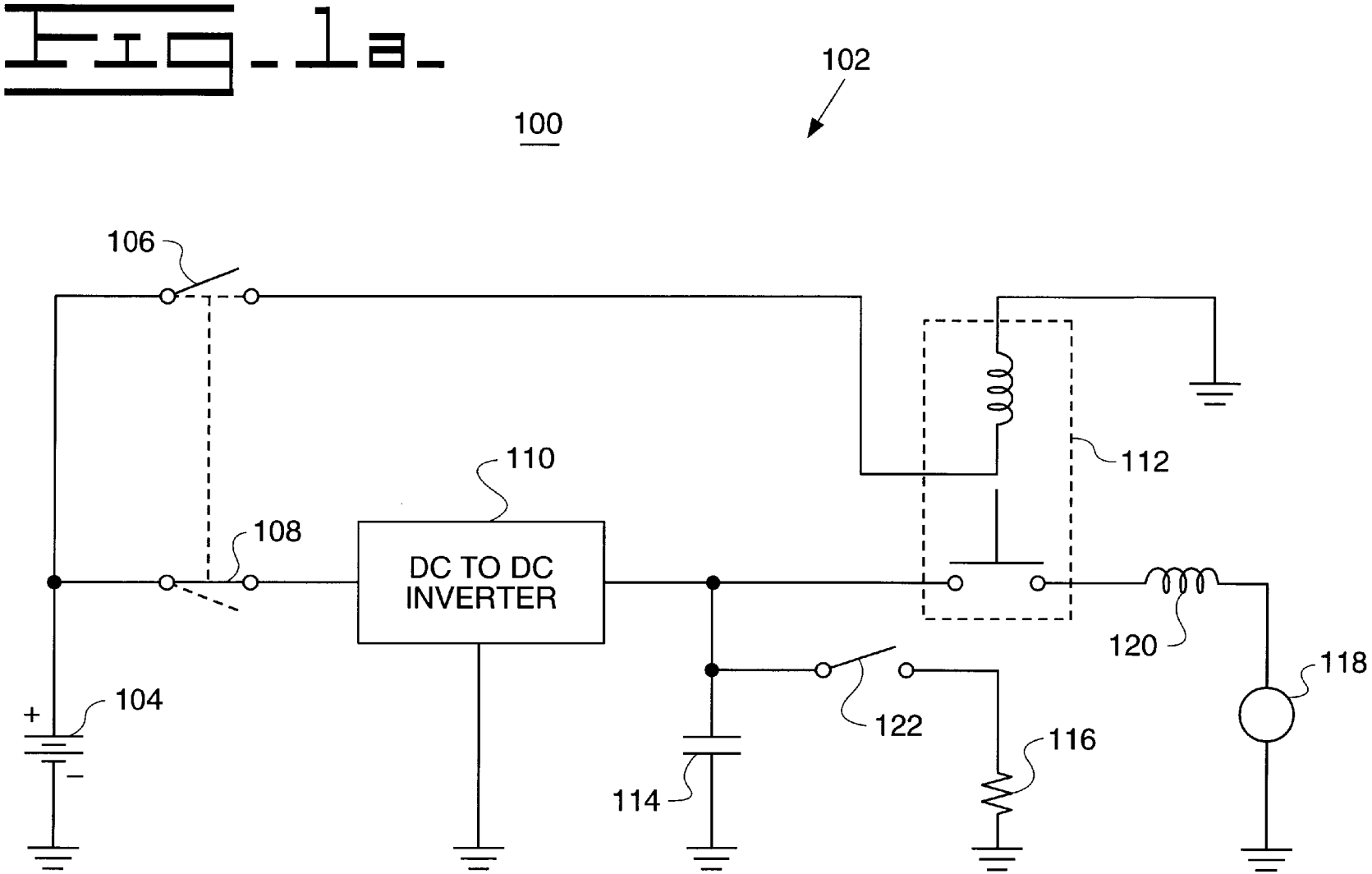
FIG. 1*a* is an electrical circuit diagram illustrating another embodiment of the present invention.

Referring to the drawings, and with particular reference to FIGS. 1 and 1*a*, an electrical circuit diagram illustrating a preferred embodiment of the present invention is shown. The diagram of FIG. 1 is an exemplary illustration of an apparatus 100 suitable for use with the present invention. It is noted that variations of the circuit diagram of FIG. 1 may be used without deviating from the scope and spirit of the invention.

The circuit diagram of FIG. 1 may be used as a starting system for an internal combustion engine 102. Internal combustion engines are widely used to power and propel mobile machines such as automobiles, trucks, construction and earthworking machines, locomotives, and the like. In addition, internal combustion engines are used to provide power for electrical generating systems.

At least one battery 104 is used to provide low voltage energy to the apparatus 100. In addition, as is well known in the art, the battery 104 may also provide low voltage energy for auxiliary applications for the engine 102 and the machine associated with the engine 102. Such applications include, but are not limited to, climate control, display gauges, electronic equipment and circuits, lighting, and the like. For the present invention, the use of the battery 104 is presented as applied to the starting system of FIG. 1.

Typical low voltage batteries provide energy at a voltage of about 12 to 36 volts. This low voltage may be provided by a single battery 104, or by a plurality of batteries 104, connected in either series or parallel. The use of multiple batteries to provide energy at a low voltage is well known in the art and will not be discussed further.

A starter switch 106 is in a normally open position until it is desired to start the engine 102, upon which the starter switch 106 is moved to a closed position. In the preferred embodiment, the starter switch 106 is coupled to a charging switch 108, either mechanically or electrically. For example, the starter switch 106 and the charging switch 108 may be mechanically coupled together so that they are both activated by a common means, such as turning a key. Alternatively, the starter switch 106 and the charging switch 108 may be electrically coupled by means such as a relay (not shown) or logic circuitry (not shown).

Preferably, the charging switch 108 is in a normally closed position until closure of the starter switch 106 causes the charging switch 108 to open. The operation and purpose of the charging switch 108 is discussed in more detail below.

A DC to DC inverter 110 receives the energy at the low voltage from the battery 104 and produces energy at a high voltage, for example greater than 100 volts. An example of a typical DC to DC inverter 110 converts energy at a first DC voltage, e.g., the low voltage from the battery 104, into a series of pulses. The pulses are then converted to energy at a second voltage value by a transformer, and then rectified to produce energy at a second DC voltage, e.g., the high voltage output of the DC to DC inverter 110 shown in FIG. 1. The construction and operation of DC to DC inverters are well known in the art and will not be discussed further.

A capacitor 114 receives the energy at the high voltage from the inverter 110, and responsively stores the energy at the high voltage. Preferably, the capacitor 114 is of a type commonly known as a super capacitor. Super capacitors are typically electric double layer capacitors, and may be capable of ratings as high as multiple farads.

A starter relay 112 is adapted to provide a connection from the capacitor 114 to start the engine 102 in response to closure of the starter switch 106. Preferably, the starter switch 106 is rated for the lower voltage from the battery 104, and the starter relay 112 is rated for the high voltage from the capacitor 114.

At least one starter motor 118 is used to drive the engine 102 to start the engine 102 in response to receiving the high voltage from the capacitor 114. In the embodiment shown in FIG. 1, three starter motors 118*a,b,c* are connected in series. Each of the three starter motors 118*a,b,c* is a low voltage starter motor, e.g., about 36 volts. Connected in series, the starter motors 118*a,b,c* require about 100 volts for starting purposes. However, by connecting multiple low voltage starter motors in series in a high voltage starter system, the amount of current required is greatly reduced. For example, in the configuration shown in FIG. 1 and described above, the current required is about one third of the current required in a typical parallel multiple starter system. For example, the current required may be reduced from about 3,000 amps to about 1,000 amps. This reduced current configuration would enable the use of smaller wiring and components, thus reducing weight and costs.

In another embodiment, one high voltage starter motor 118 may be used. In yet another embodiment, one low voltage starter motor 118 may be used, and the energy at the high voltage supplied by the capacitor 114 may be delivered so that the capacitor only provides the electrical energy needed to drive the low voltage starter motor 118, for example by the use of a voltage divider network (not shown).

A current control inductor 120 is preferably provided between the capacitor 114 and the at least one starter motor 118 to control the current being delivered to the starter motor 118.

A bleeder resistor 116 is connected in parallel with the capacitor 114 through a bleeder switch 122. The bleeder switch 122 is open during normal operations. However, a predetermined condition causes the bleeder switch 122 to close, thus causing the energy stored in the capacitor 114 to discharge through the bleeder resistor 116. An example of a predetermined condition is the engine 102 being accessed by a person, e.g., an operator or service person accessing the engine 102 for maintenance purposes.

Figure 2:
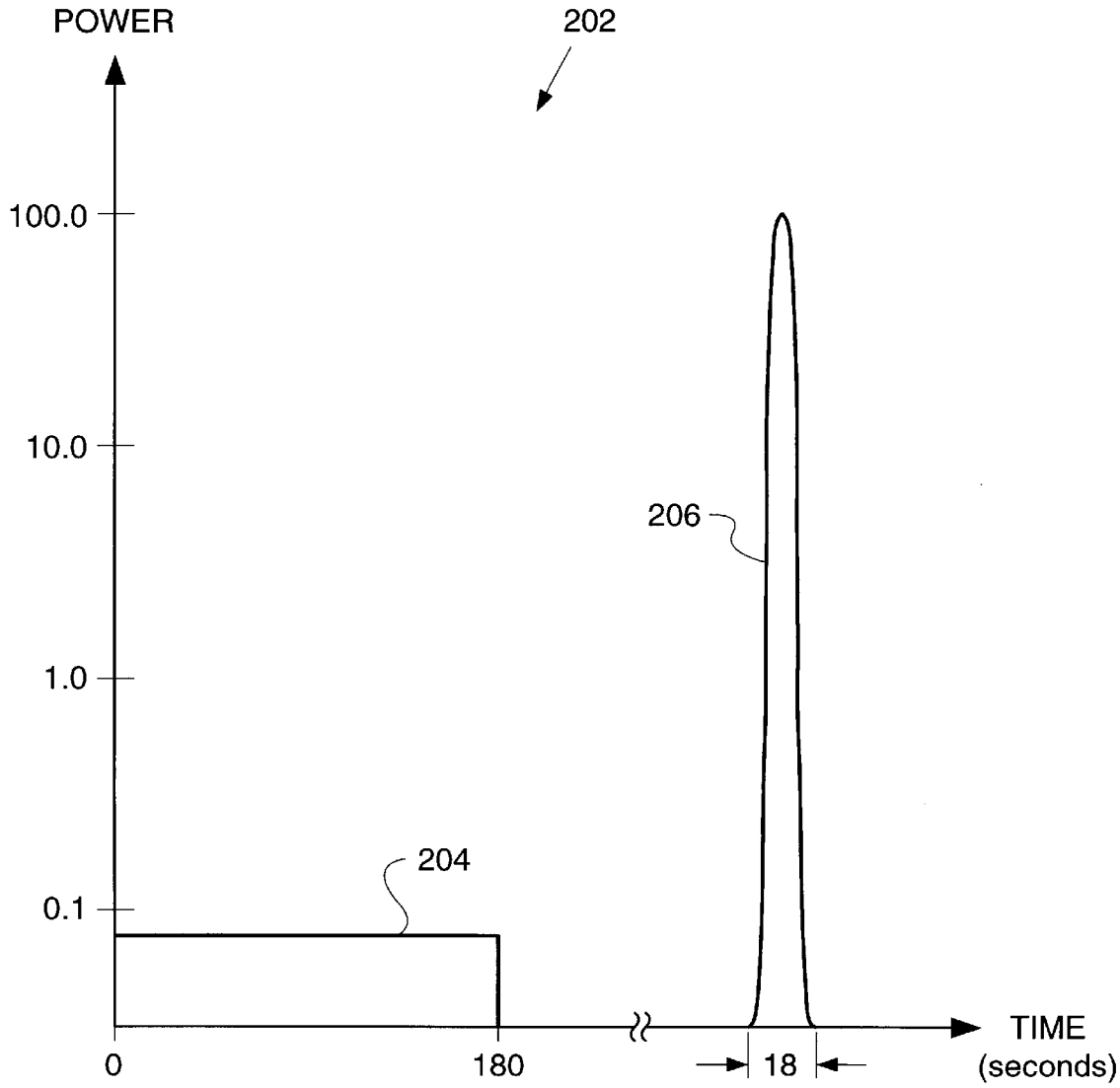
FIG. 2 is a power vs. time graph illustrating charging and discharging times of a capacitor used in the circuit of FIG. 1.

Referring now to FIG. 2, a graph 202 of power vs. time is shown. It is noted that the scales on the axis are exemplary only, and do not indicate any values that are necessary for the present invention. For example, the vertical axis, i.e., power, is not assigned any units of measurement, and the values given are merely arbitrary.

A representation 204 of power vs. time of the capacitor 114 charging illustrates that the capacitor 114 is charged for a relatively long period of time, for example 180 seconds, at low power. Under these conditions, the power drain on the battery 104 is minimized during charging of the capacitor 114. This low power, long period charging process prevents the battery 104 from being subjected to the stresses of deep charge and discharge cycles, thus extending the life of the battery 104.

The power vs. time curve 206 of the capacitor 114 discharging, for example, when used to drive the starter motors 118 to start the engine 102, indicates that the capacitor 114 discharges a large amount of power in a short period of time. For example, the capacitor 114 may discharge in about 18 seconds, or about one tenth of the time that it took to charge the capacitor 114. The process of charging the capacitor 114 at low power over a long period of time and then discharging the capacitor 114 at high power over a short period of time is known as energy compression, or pulse power. It is noted that the 180 second charge time, the 18 second discharge time, and the 10 to 1 energy compression ratio are merely examples used for purposes of illustration. Other charge and discharge times and ratios may be used without deviating from the invention.

Figure 3:
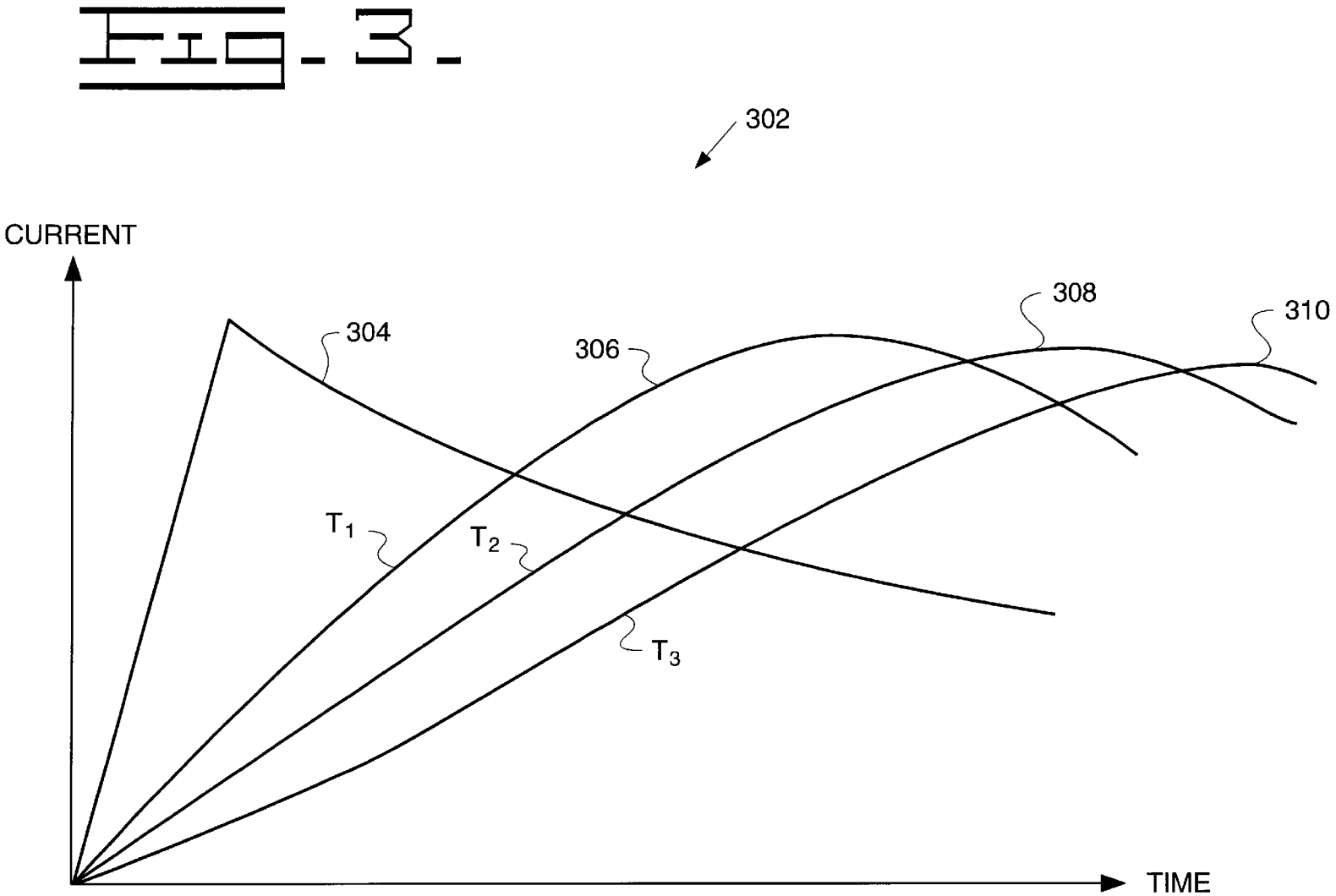
FIG. 3 is a current vs. time graph illustrating current delivery vs. time of a capacitor and a battery.

Referring now to FIG. 3, a graph 302 of current vs. time is shown. It is noted that the axes of the graph 302 are not drawn to any scale and do not depict any units of measurement. The curves shown on the graph are used to illustrate comparative features for purposes of illustration only.

A curve 304 of the current vs. time of the capacitor 114 illustrates that the capacitor 114 is capable of providing a maximum value of current quickly, which then slowly decreases as the capacitor 114 is discharged. It is noted that the curve 304 of the capacitor 114 is independent of temperature.

Curves 306,308,310 of the current vs. time of the battery 104 at three temperatures $T_1$, $T_2$, $T_3$ illustrate that the battery 104 takes longer than the capacitor 114 to provide maximum current for purposes of starting the engine 102. In addition, $T_3$ is a lower temperature than $T_2$, which is a lower temperature than $T_1$. Therefore, as shown in the graph 302, as the temperature decreases, the length of time for the battery 104 to reach maximum current output increases. This results in longer starting times in cold conditions, which places additional stress on the battery 104. In addition, the internal resistance of the battery 104 increases as the temperature decreases. The higher internal resistance lowers the maximum output current of the battery 104. Therefore, as shown in FIG. 3, as the temperature decreases, the maximum output current of the battery 104 decreases.

Figure 4:
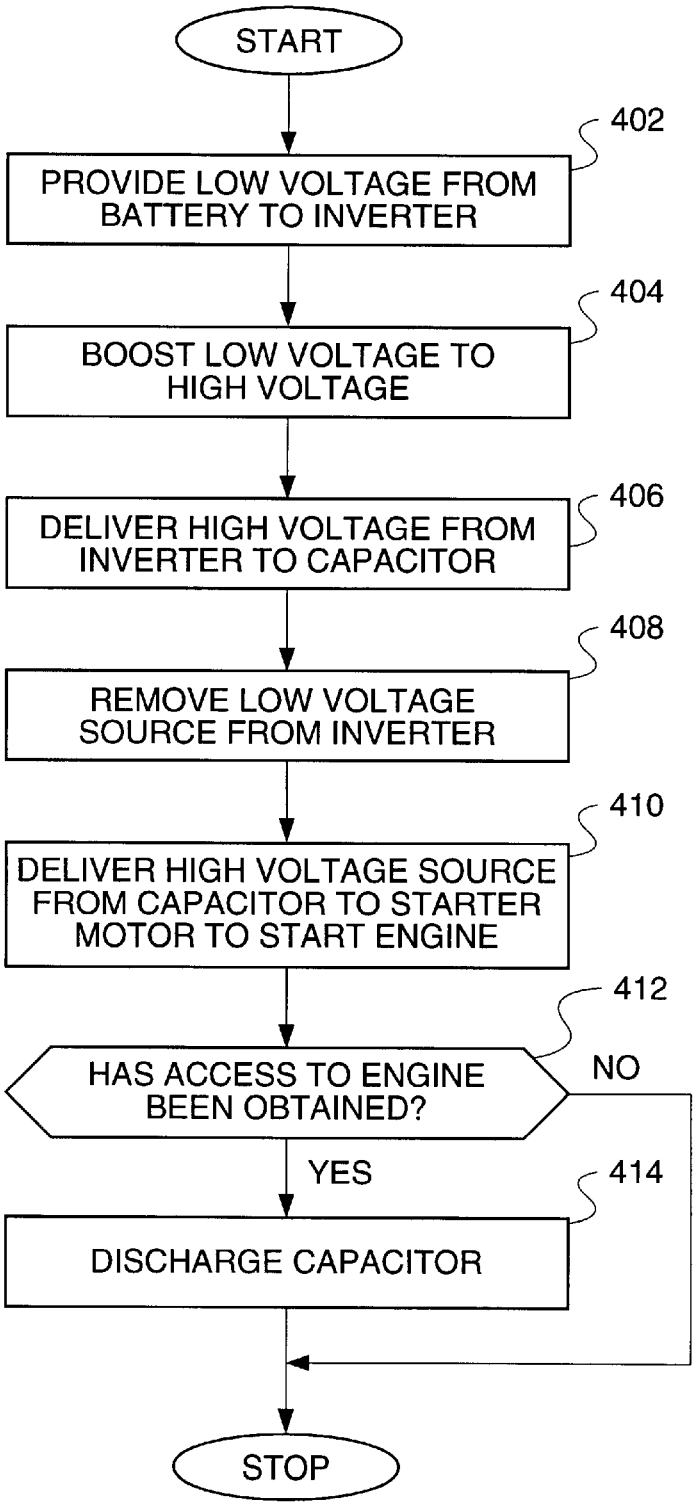
FIG. 4 is a flow diagram illustrating a preferred method of the present invention.

With reference now to FIG. 4, a flow diagram illustrating a preferred method of the present invention is shown.

In a first control block 402, energy at a low voltage, e.g., 12 to 36 volts, is provided by the battery 104 to the DC to DC inverter 110.

In a second control block 404, the energy at the low voltage is boosted to energy at a high voltage, e.g., greater than 100 volts, by the inverter 110.

In a third control block 406, the energy at the high voltage is delivered from the inverter 110 to the capacitor 114. The capacitor 114, in turn, is charged to the energy at the high voltage.

In a fourth control block 408, the low voltage source is removed from the inverter 110. More specifically, the battery 104 is disconnected from the inverter 110 by the charging switch 108 in response to activation of the starter switch 106. As a result, the battery 104 is not used as part of the engine starting system, but is used to charge the capacitor 114 and for auxiliary applications, as described above.

In a fifth control block 410, energy at the high voltage stored in the capacitor 114 is delivered to the at least one starter motor 118 to responsively start the engine 102. As shown in FIG. 1, the energy at the high voltage from the capacitor 114 is delivered in response to activation of the starter relay 112.

In a first decision block 412, a determination is made if access to the engine 102 has been obtained. If yes, then control proceeds to a sixth control block 414, where the capacitor 114 is discharged through the bleeder resistor 116.

INDUSTRIAL APPLICABILITY

As an example of an application of the present invention, three starter motors 118*a,b,c* are connected in series as shown in FIG. 1 and described above in the specification. Each starter motor 118 requires about 36 volts to operate, thus resulting in a total need for about 100 volts to drive all three starter motors 118*a,b,c*.

If a plurality of batteries 104 were used to drive the starter motors 118*a,b,c* , the batteries 104 would be required to deliver energy at about 100 volts at a current of about 1,000 amps in a very short period of time. This large drain of the batteries 104 during discharge and the resultant charge cycle after use causes severe stress on the batteries 104. Consequently, the batteries 104 may have an expected life span of about three years.

If, as the prior art teaches, a capacitor is used to supplement the batteries during starting of an engine, the batteries are still subjected to major discharging and recharging since the batteries are delivering a constant charge to the capacitor during the starting process. Therefore, the batteries are still subjected to severe stress, which shortens the expected life of the batteries.

The present invention offers the advantage of removing the battery 104 from the starting circuit during starting, thus eliminating the stress of large charge-discharge cycles, and extending the useful life of the battery 104. The present invention also offers the advantage of providing energy at a large voltage, e.g., greater than 100 volts, from a capacitor 114 for starting an engine 102.

Other aspects, objects, and features of the present invention can be obtained from a study of the drawings, the disclosure, and the appended claims.

What is claimed is:

1. A method for starting an internal combustion engine using energy stored in a capacitor, including the steps of:

providing energy at a low voltage from at least one battery to an inverter;

boosting the energy at the low voltage to energy at a high voltage, the high voltage being greater than 100 volts;

delivering the energy at the high voltage from the inverter to a capacitor;

automatically removing the low voltage source from the inverter during the period of time the engine is being started; and delivering the energy at the high voltage from the capacitor to at least one starter motor to responsively start the engine.

2. A method, as set forth in claim 1, wherein providing energy at a low voltage includes the step of providing energy at about 12 to 36 volts to the inverter.

3. A method, as set forth in claim 1, wherein delivering the energy at the high voltage from the capacitor to at least one starter motor includes the step of delivering the energy at the high voltage to a high voltage starter motor.

4. A method, as set forth in claim 1, wherein delivering the energy at the high voltage from the capacitor to at least one starter motor includes the step of delivering a portion of the energy at the high voltage to a low voltage starter motor.

5. A method, as set forth in claim 1, wherein delivering the energy at the high voltage from the capacitor to at least one starter motor includes the step of delivering the energy at the high voltage to a plurality of starter motors.

6. A method, as set forth in claim 5, wherein the plurality of starter motors are low voltage starter motors connected in series.

7. A method, as set forth in claim 1, wherein providing energy at a low voltage includes the step of providing energy at a low voltage over a long period of time.

8. A method, as set forth in claim 7, wherein a long period of time is about 180 seconds.

9. A method, as set forth in claim 1, wherein delivering the energy at the high voltage from the capacitor to at least one starter motor includes the step of delivering the energy at the high voltage over a short period of time.

10. A method, as set forth in claim 9, wherein a short period of time is about 18 seconds.

11. A method, as set forth in claim 1, further including the step of discharging the energy at the high voltage from the capacitor in response to a predetermined condition.

12. A method, as set forth in claim 11, wherein the predetermined condition is the internal combustion engine being accessed by a person.

13. An apparatus for starting an internal combustion engine using voltage stored in a capacitor, comprising:

at least one battery for providing energy at a low voltage;

a DC to DC inverter for receiving the energy at the low voltage and producing energy at a high voltage, the high voltage being greater than 100 volts;

a capacitor for receiving and storing the energy at the high voltage;

means for automatically removing the low voltage source from the inverter during the period of time the engine is being started; and at least one starter motor adapted to receive the energy at the high voltage from the capacitor and responsively start the engine.

14. An apparatus, as set forth in claim 13, wherein the low voltage is about 12–36 volts.

15. An apparatus, as set forth in claim 13, wherein the at least one starter motor is a high voltage starter motor.

16. An apparatus, as set forth in claim 13, wherein the at least one starter motor is a low voltage starter motor.

17. An apparatus, as set forth in claim 13, wherein the at least one starter motor is a plurality of starter motors.

18. An apparatus, as set forth in claim 17, wherein the plurality of starter motors are low voltage starter motors connected in series.

19. An apparatus, as set forth in claim 13, further including means for discharging the energy at the high voltage from the capacitor in response to a predetermined condition.

20. An apparatus, as set forth in claim 19, wherein the means for discharging the energy at the high voltage from the capacitor is a bleeder resistor connected in parallel with the capacitor.

21. An apparatus, as set forth in claim 20, wherein the predetermined condition is the internal combustion engine being accessed by a person.

22. An apparatus, as set forth in claim 13, further including a current control inductor electrically connected between the capacitor and the at least one starter motor.

23. An apparatus, as set forth in claim 13, wherein the means for automatically removing the low voltage source from the inverter includes a charging switch coupled to a starter switch.

24. An apparatus, as set forth in claim 23, wherein the charging switch is adapted to open when the starter switch is closed.

* * * * *